United States Patent [19]

Yamamoto

[11] 4,084,875

[45] Apr. 18, 1978

[54] ELECTRICAL CONNECTOR

[75] Inventor: Stephen K. Yamamoto, Los Angeles, Calif.

[73] Assignee: International Telephone and Telegraph Corporation, New York, N.Y.

[21] Appl. No.: 540,252

[22] Filed: Jan. 10, 1975

[51] Int. Cl.[2] ..... H01R 13/52

[52] U.S. Cl. ..... 339/94 M; 339/113 R; 340/252 P

[58] Field of Search ..... 339/94, 74, 111, 113, 339/147, 195, 196, 217; 340/248 R, 252 P

[56] References Cited

U.S. PATENT DOCUMENTS

| | | | |
|---|---|---|---|
| 2,655,638 | 10/1953 | Allen | 339/94 M |
| 2,731,629 | 1/1956 | Siderman | 340/252 P |
| 3,170,752 | 2/1965 | Van Horssen | 339/74 R |
| 3,196,424 | 7/1965 | Hardesty et al. | 339/113 L |
| 3,474,386 | 10/1969 | Link | 339/111 |
| 3,569,908 | 3/1971 | Appleton | 339/111 |
| 3,716,817 | 2/1973 | Wolfe, Jr. et al. | 339/111 |
| 3,789,346 | 1/1974 | De Brick | 339/94 R |

*Primary Examiner*—Joseph H. McGlynn
*Attorney, Agent, or Firm*—A. Donald Stolzy

[57] ABSTRACT

An electrical connector having means providing a signal when the connector members are fully interengaged. The signal means includes a pair of contacts in the two connector members which are axially spaced apart a distance greater than that of the power contacts in the two members so that the power contacts will become electrically coupled prior to the signal contacts when the connector members are mated. The signal contacts are preferably fixedly mounted in the connector insulators and conductors are releasably coupled to the rear portions of such contacts.

4 Claims, 3 Drawing Figures

ELECTRICAL CONNECTOR

BACKGROUND OF THE INVENTION

This invention relates generally to an electrical connector and, more particularly, to an electrical connector embodying means for indicating when the two connector members of the connector are fully mated together.

An electrical connector comprises plug and receptacle connector members each including a shell containing an insulator. A plurality of pairs of axially aligned contacts are mounted in the respective insulators in the two connector members. In many applications, it is necessary to provide an interfacial seal on one of the insulators to assure that a complete sealing condition is established for each mated pair of contacts when the two connector members are interengaged. Also, typically a peripheral seal is provided in one of the connector shells engageable by the shell of the other connector member to prevent the intrusion of dust or moisture into the interior of the connector. Also, a coupling nut is mounted on the plug connector member for interengaging the two members, bringing the contacts of each pair of contacts into electrically coupled condition, and establishing the interfacial and peripheral sealing conditions in the connector. Generally, the contacts in the connecter members are removably mounted therein so that they may be replaced in the field. Because of the use of such a contact mounting arrangement, and the large number of parts in an electrical connector, there is a large buildup of manufacturing tolerances which must be maintained to insure that all contacts are fully electrically coupled together, that the interfacial and peripheral seals are established, and that the coupling nut is in its fully coupled position. The maintenance of such tolerances addes considerably to manufacturing costs. Furthermore, when manufacturing tolerances are not met, there is generally no way of determining whether or not all the aforementioned conditions have been established when two electrical connector members are coupled together. This may become a considerable problem in electronic systems utilizing a large number of connectors since there is no way of determining which connector in the system is not fully operational if the system fails. Furthermore, it is on some occasions desirable to known in advance whether all the connectors are functional. It is the object of the present invention to provide an electrical connector which incorporates means for giving a signal when the connector is fully coupled together, thus enabling the operator to determine which line in the electronic system is not operable.

SUMMARY OF THE INVENTION

According to the principal aspect of the present invention, there is provided an electrical connector which contains, in addition to the standard power contacts in the two connector members, a pair of signal contacts which do not become electrically coupled until after the power contacts are coupled together upon interengagement of the two connector members. A signaling device is coupled to the signal contacts, providing an indication that the signal contacts, and hence the power contacts, are electrically mated. In the preferred embodiment of the invention, one of the connector members carries a coupling nut which, when fully coupled, assures that a complete sealing condition is established at an interfacial seal and peripheral seal provided between the two connector members. Thus, the signaling device also provides an indication that the coupling nut is in its fully coupled position and that the interfacial and peripheral seals have been fully established.

DESCRIPTION OF THE PREFERRED EMBODIMENTS

Figure 1:
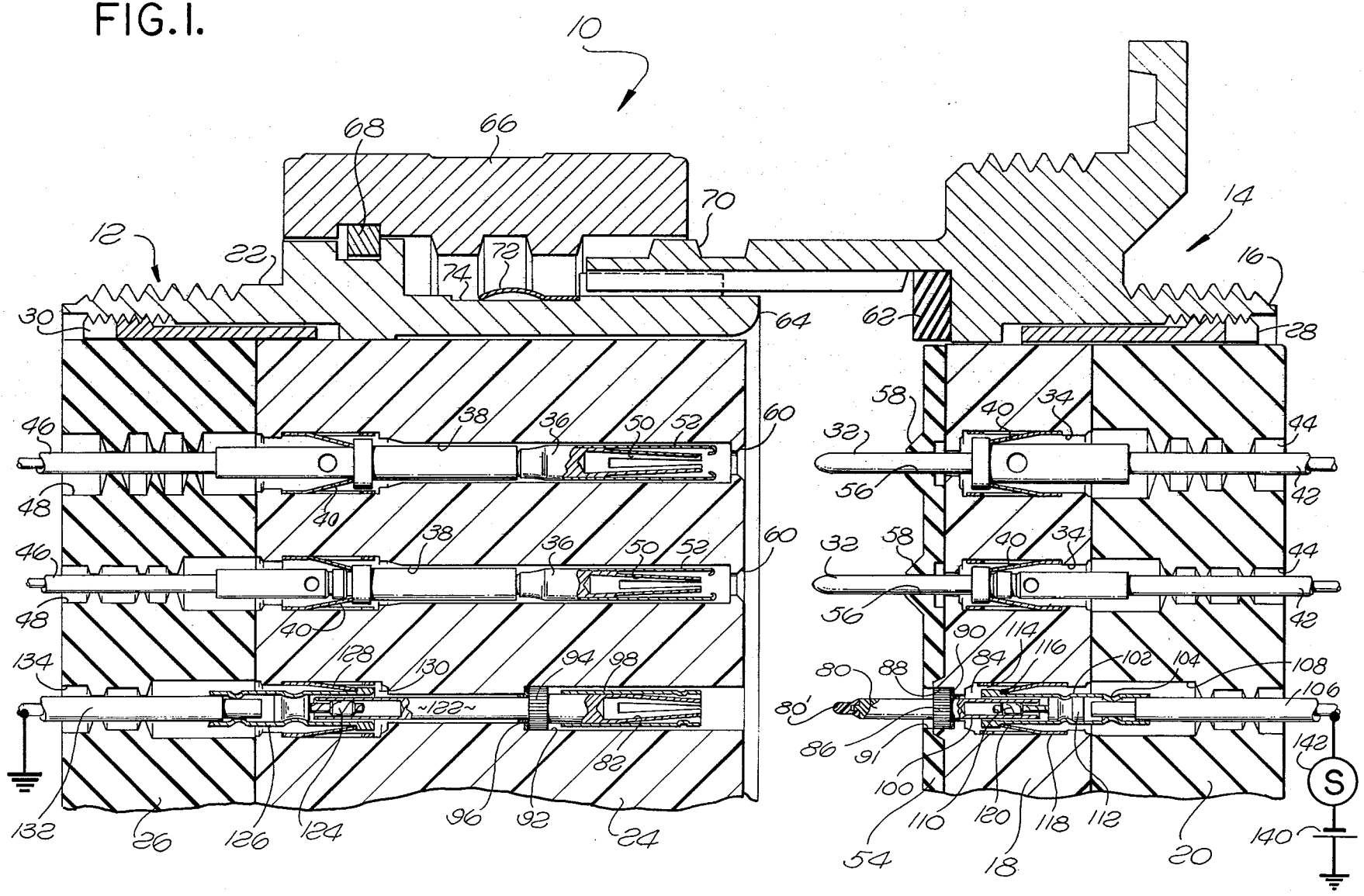
FIG. 1 is an exploded partial longitudinal section of the connector of the present invention, showing the receptacle connector member and plug connector member disengaged from each other.

Referring now to the drawings in detail, there is illustrated the connector of the present invention, generally designated 10, which includes a plug connector member 12 and a receptacle connector member 14. The receptacle connector member 14 comprises a shell 16 containing a rigid dielectric insulation body 18 and a wire sealing grommet 20 behind the body 18. The body 18 is preferably molded of reinforced epoxy thermoset material. The grommet 20 is preferably molded of high strength silicone base elastomer. The plug connector member 12 also comprises a shell 22 containing an insulation body 24 and a rear wire sealing grommet 26. Threaded sleeves 28 and 30 hold the respective insulation bodies and grommets in the shells 16 and 22.

The receptacle connector member 14 contains plurality of power pin contacts 32 mounted in longitudinally extending bores 34 in the insulation body 18. The plug connector member 12 contains a plurality of power socket contacts 36 mounted in bores 38 in the insulation body 24 axially aligned with the bores 34 adapted to be electrically coupled with the pin contacts 32 when the connector members are interengaged. The contacts 32 and 36 are removably mounted within the bores 34 and 38 respectively by contact retention clips 40, which will be described in some detail later. The pin contacts 32 are connected to the ends of insulated wires 42 that pass through passages 44 in the rubber grommet aligned with the bores 34. The socket contacts 38 in the plug connector member 12 terminate insulated wires 46 which extend through passages 48 in the grommet 26 aligned with the bores 38. The socket contacts 36 are longitudinally split to provide resilient contact fingers 50 which expand when the pin sockets 32 are slidably inserted into the socket contacts. Preferably a fixed sleeve 52 surrounds each socket contact 36 to protect the fingers 50 and limit radial travel of the fingers upon insertion of the pin contacts into the socket contacts.

An interfacial seal 54, preferably formed of silicone base elastomer, is bonded to the front face of the insulation body 18. The seal 54 contains openings 56 through which the pin contacts extend. An individual conical shaped sealing barrier 58 is integrally formed on the interfacial seal 54 coaxial with each passage 56 and extends in the direction of the insulation body 24 on the mating connector member 12. The body 24 is formed with closed entry contact lead-in chamfers 60 coaxial with the bores 38. When the connector members are interengaged, each sealing barrier 58 squeezes into the lead-in chamfer 60 in the insulation only 24 to provide an effective seal for the mated contacts.

The shell 16 of the receptacle connector member 14 contains a peripheral seal 62 which is engaged by the end 64 of the shell 22 when the two connector members are interengaged. A coupling nut 66 is rotatably mounted on the shell 22. The nut 66 is held against axial movement relative to the shell by a wire 68. The nut is internally threaded, and cooperates with threads 70 on the outer surface of the shell 16 whereby rotation of the coupling nut draws the two shells 16 and 22 toward each other, effecting interengagement of the two connector members. When the coupling nut is in its fully coupled position, the respective pin contacts 32 and socket contacts 36 are electrically engaged, the end 64 of the shell 22 deforms the seal 62, establishing a peripheral sealing condition between the two connector members, and the sealing barriers 58 of the interfacial seal 54 are squeezed into the lead-in chamfers on the front face of the insulation body 24, providing an interfacial seal for each set of contacts. Preferably a metal grounding spring 72 is mounted in a groove 74 in the outer surface of the shell 22 which electrically engages the shell 16 of the connector member 14.

The parts of the connector 10 described so far are generally conventional and constitute no part of the present invention. As explained previously herein, because of the large number of parts in an electrical connector, and the removable mounting of the power contacts by the retention clips 40, sometimes full electrical coupling between the contact pairs is not achieved, or the peripheral or interfacial seals are not fully made when the coupling nut interengages the connector members.

At the present time there is no way the user can determined that a fault in an electrical system with which he is concerned exists in a connector, or in a particular connector out of a large number of connectors. The purpose of the present invention is to provide means for indicating an electrical connector is not fully interengaged to provide the necessary seals and elctrical continuity required for the electrical system.

In accordance with the present invention, there is provided in the connector 10 a pair of signal contacts which do not become electrically coupled until electrical continuity is established between the power contacts in the connector, the interfacial and peripheral seals are fully made, and the coupling nut is in its final coupled position. The signal contacts include a pin contact 80 and a socket contact 82 mounted in the receptacle and plug members 14 and 12, respectively. The pin contact 80 is mounted in a longitudinally extending bore 84 in the insulation body 18. The contact 80 has a knurled flange 86 which is press fitted into a recess 88 coaxial with the bore 84 and opening at the front face of the insulation body 18. A suitable cement or epoxy 90 serves to bond the contact fixedly in place within the insulation body. It is noted that the interfacial seal 54 has an opening 91 therein continuous with the recess 88 and no sealing barrier 58 is provided for the signal contacts. The signal socket contact 82 is mounted in a bore 92 axially aligned with the bore 84. The contact 82 also embodies a knurled flange 94 which is pressed into the bottom of the bore 92 and bonded thereto as indicated at 96. A sleeve 98, similar to the sleeves 52, surrounds the socket contact 82. Thus, in contrast to the power contacts 32 and 36, the signal contacts are fixedly mounted in their respective insulators so that their axial position may be definitively established as will be described later. Since the signal contacts are fixedly mounted in the respective connector members, it is necessary to provide a releasable electrical connection between the contacts and their respective wires. To this end, the rear portion 100 of the pin contact 80 is formed as a socket contact element. A tubular sleeve 102 is mounted in the bore 84 and crimped at its rear end 104 to the bare end of an insulated wire 106 which extends through a bore 108 in the grommet 20 coaxial with the bore 84. A pin contact 110 is axially positioned within the sleeve 102 and fixed relative thereto by crimping the sleeve onto a shank 112 which carries the pin contact. As shown in the drawing, the pin contact is in the form of a twist pin, the structure of which is well known in the art. Obviously, other forms of pin contacts could be utilized. The pin contact is spaced from the sleeve defining an annular space 114 therebetween which receives the socket contact element 100 when the sleeve 112 is fully assembled to the rear of pin contact 80. The sleeve 112 is formed with a rearwardly facing shoulder 116. A contact retention clip 118 is mounted in the bore 84 surrounding the sleeve 102. This clip, which may be identical to the clips 40, embodies a pair of radially inwardly forwardly extending resilient fingers 120. When the sleeve 112 terminating the insulated wire 106 is inserted into the bore 84 from the rear of the connector member 14, the enlarged forward end of the sleeve will spread the retention fingers 120 apart, until the shoulder 116 passes the forward ends of the finger wherein the fingers will contract and abut such shoulder, thereby preventing the sleeve from being withdrawn from the bore 84. Reference is made to U.S. Pat. No. 3,158,424 for a detailed disclosure of such a retention clip and means for releasing the clip to allow the sleeve to be withdrawn rearwardly from the insulator. Such disclosure is incorporated herein by reference. Thus, the invention provides means for making a releasable connection between the insulated wire 106 and the signal pin contact 80.

The rear portion 122 of the socket contact 82 is also formed as a socket contact element, slidably receiving a pin contact 124 mounted in a sleeve 126, releasably retained by a retention clip 128 in a bore 130 in the insulation body 24 in the same manner described with respect to the signal pin contact 80. The sleeve 126 is crimped to an insulated wire 132 which extends rearwardly through a bore 134 in the grommet 26.

While the contact retention clips 118 and 128 have been shown as being separate metal clips, it will be appreciated that the retention members may constitute integral cones molded with the insulation bodies, as disclosed in U.S. Pat. No. 3,165,369. Certainly, other forms of retention devices may be utilized for the signal contacts, allowing the sleeves 112 and 126 to be releasably connected thereto. Further, it will be appreciated that the rear portion of each of the signal contacts could be formed as a pin contact, rather than as a socket contact element, in which case such pin contacts could be slidably received directly into the sleeves 102 and 126.

According to the invention, the signal contacts 80 and 82, which are fixedly mounted within the respective connector members, are located therein so that electrical coupling between the contacts will not occur until after the power contacts 32 and 36 have been electrically coupled, the interfacial and peripheral seals have been fully engaged and the coupling nut is in its full coupling position. To this end, as best seen in FIG. 1, the signal contacts are mounted in the two connector members, so that when such members are spaced apart axially a predetermined distance, the forward conductive ends of the signal contacts are spaced a distance apart further than the forward conductive ends of the power contacts 32 and 36. As illustrated in the drawing, the forward ends of the power socket contacts 36 are substantially aligned with the forward end of the signal socket contact 82, but the forward ends of the power pin contacts 32 extend forwardly of the forward end of the signal pin contact 80. The forward portion of the signal pin contact 80 may be formed of conductive material. As well known in the art, the point of complete electrical mating between two contacts is not precisely defined due to the sliding engagement between the rounded forward end of the pin contact and the resilient fingers of the socket contact. Therefore, it is preferred that the forward end of the pin contact be a dielectric tip 80'. The rear end of the dielectric tip 80' provides a precise plane of electrical engagement between the pin contact 80 and the socket contact 82. The dielectric tip is particularly useful when the tolerance buildup in the connector is substantial.

Figure 2:
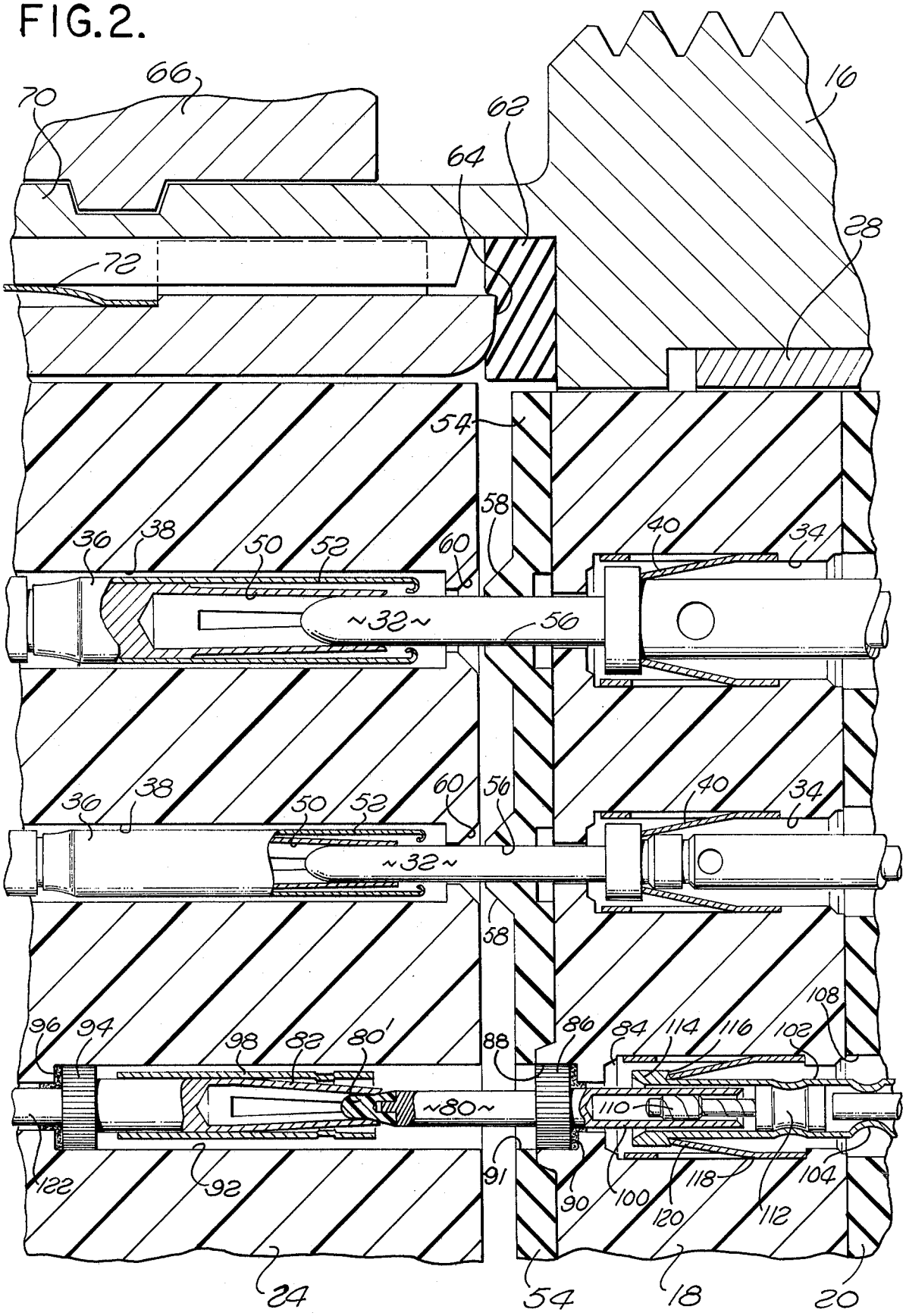
FIG. 2 is a partial longitudinal section of the connector, showing the receptacle and plug connector members in a partial interengaged position.
Figure 3:
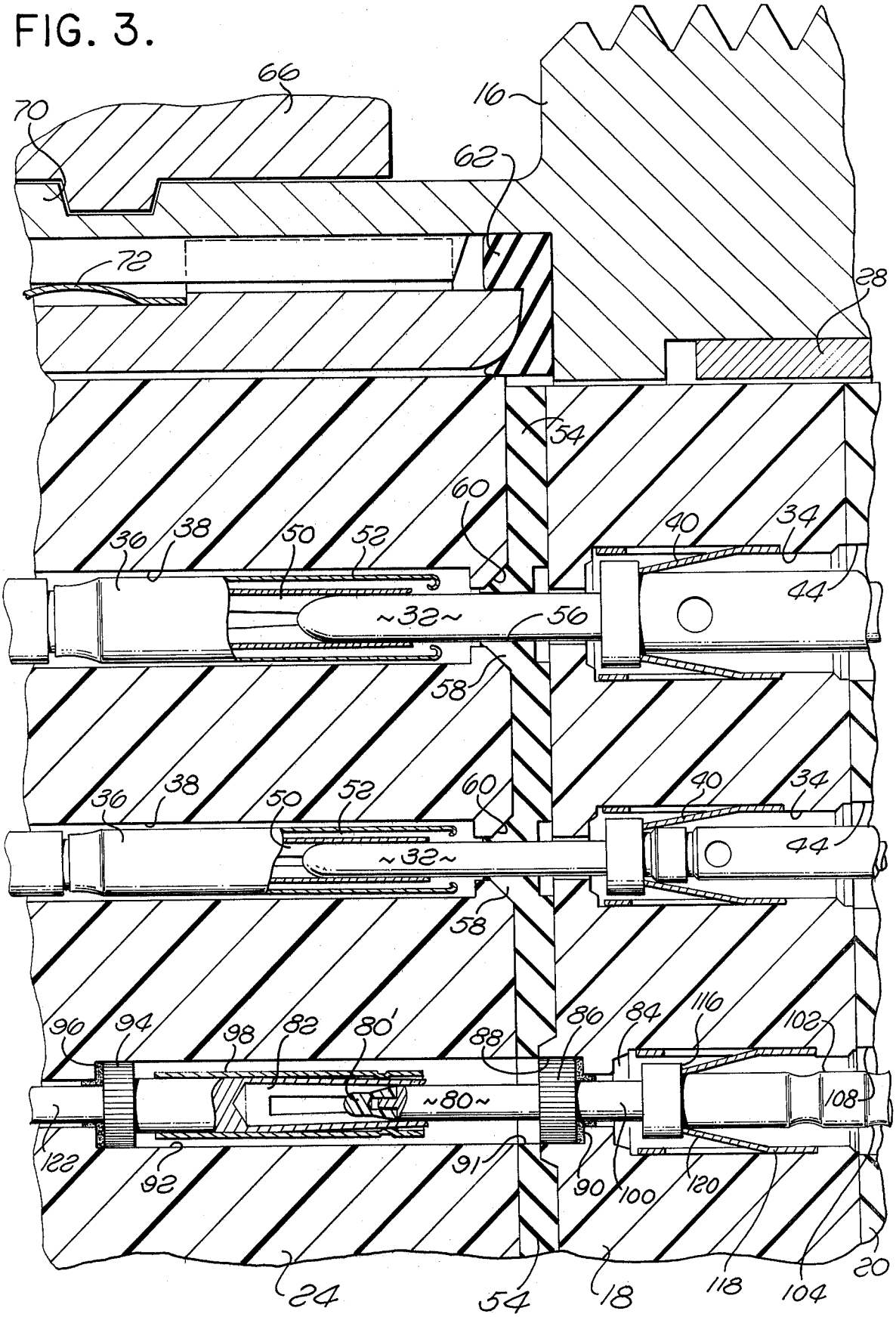
FIG. 3 is a partial longitudinal section of the connector, showing the receptacle and plug connector members fully engaged.

When the connector 10 of the present invention is utilized in an electrical system, the signal contacts 80 and 82 will be connected in a circuit containing a power source 140 and a signal indicator 142, which may be a light or a buzzer, for example. In operation, the connector members 12 and 14 are positioned as shown in FIG. 1 of the drawings wherein the respective power and signal contacts are aligned. The two connector members are than interengaged and the coupling nut 66 is rotated pulling the plug shell 12 into the receptacle shell 14 causing initial contact of the grounding spring 72 with the receptacle shell. Additional rotation of the coupling nut causes the power contacts 32, 36 to engage, but the signal pin contact 80 is still axially displaced from the socket contact 82. Continued rotation of the coupling nut causes the dielectric tip 80' of the pin contact 80 to slide into the signal socket contact 82, followed by commencement of peripheral and interfacial sealing, as illustrated in FIG. 2. It is noted that in the position illustrated in FIG. 2, the signal pin contact 80 has not yet made electrical engagement with the signal socket contact 82, yet the power contacts 34 and 36 are electrically coupled together. Finally, rotation of the coupling nut to its fully coupled position essentially simultaneously causes the conductive portion of the signal pin contact to engage the signal socket contact. At this point, the sealing barriers 58 of the interfacial seal are fully squeezed into the lead-in chamfers 60 on the insulation body 24 completing the interfacial seal and the end 64 of shell 22 fully compresses the peripheral seal 62 as seen in FIG. 3. Once the signal contacts are electrically coupled together, the indicator 142 provides a signal indicating that electrical continuity has been made through the power contact, full sealing of the connector halves has been completed, and the coupling nut is in its final position. If the indicator 142 is not energized, the user knows the plug and receptacle members 12 and 14 of the connector have not been fully interconnected.

As will be appreciated, the principal features of the present invention can be incorporated into any form of electrical connector. The connector does not necessarily require interfacial or peripheral seals, or for that matter a coupling nut. The invention would be useful, for example, in merely providing a signal indication of the mating of power contacts by the use of the signal contacts 80 and 82. It will also be apparent to those skilled in the art that the advantages of the present invention will be achieved in a connector wherein all the contacts are initally terminated to wires and then molded into insulators, so that all the contacts are fixed, rather than removable as is the case of the power contacts and the termination sleeves 102 in the present invention. Further, the power and signal contacts need not necessarily be in the form of sockets and pin contacts. For example, the contacts may be in the form of blade contacts and mating tuning fork contacts. Other modifications and variations of the invention will be apparent to those skilled in the art.

What is claimed is:

1. An electrical connector comprising:

an insulator having a bore therein;

a contact fixedly mounted in said bore, said contact having a forward contacting portion of a rear contacting portion;

a mating contact element is said bore behind said contact being in releasable electrical engagement with said rear contacting portion of said contact, said mating contact element incorporating means adapted for connection to a conductor passing outwardly through the rear of said bore;

said rear contacting portion of said contact being formed as a socket contact;

said mating contact element comprising a pin contact slidable into said socket contact;

a sleeve fixed to and surrounding said pin contact providing an annular space therebetween receiving said socket contact;

said sleeve having a rearwardly facing shoulder thereon; and means releasably retaining said mating contact element in said bore, said retaining means comprising a radially inwardly forwardly extending resilient finger means in said bore engaging said shoulder.

2. An electrical connector as recited in claim 1 wherein:

the rear portion of said sleeve is hollow providing a crimp barrel for connection to said conductor.

3. An electrical connector comprising: interengageable receptacle and plug members, each member comprising a shell containing an insulation body; a plurality of pairs of axially aligned first contacts mounted in said bodies respectively, the axially aligned contacts of each pair being in an electrically coupled condition when said receptacle and plug members are interengaged; sealing means between said receptacle and plug members being in sealing condition when said receptacle and plug members are interengaged; coupling means on one of said shells engageable with the other shell for establishing an interengaged condition between said receptacle and plug members; and electrical means providing an audio or visual signal when at least one of said conditions is established, said signal means comprising a pair of axially aligned second contacts in said bodies, respectively, the axial spacing between the forward electrically conductive ends of said second contacts being greater than the axial spacing between the respective contacts of each said first-mentioned pairs of contacts before said receptacle and plug members are interengaged by said coupling means, said second contacts being fixedly mounted in their respective insulation bodies; the rear ends of said second contacts being formed as contact elements; mating contact elements releasably engaged with said contact element-formed rear ends of said second contacts, said mating contact elements being adapted to terminate electrical conductors passing outwardly through said insulation bodies; and means releasably retaining said mating contact elements in said bodies, the rear end of each said second contact being formed as a socket contact; and each said mating contact element comprising a pin contact slidable into said socket contact, a sleeve being fixed to and surrounding each said pin contact providing an annular space therebetween slidably receiving said socket contact; said sleeve having a rearwardly facing shoulder thereon; and said retaining means comprising a radially inwardly forwardly extending resilient finger means in said body engaging said shoulder.

4. An electrical connector comprising: interengageable receptacle and plug members each having an insulation body; means for coupling said members together; a plurality of pairs of axially aligned contacts mounted in said bodies respectively; a pair of axially aligned second contacts mounted in said bodies respectively; said contacts being axially positioned in their respective bodies so that when said plug and receptacle members are interengaged by said coupling means said first contacts will become electrically coupled together prior to said second contacts; said second contacts being fixedly mounted in their respective insulation bodies; the rear ends of said second contacts being formed as contact elements; mating contact elements releasably engaged with said contact element-formed rear ends of said second contacts, said mating contact elements being adapted to terminate electrical conductors passing outwardly through said insulation bodies; and means releasably retaining said mating contact elements in said bodies, the rear end of each said second contact being formed as a socket contact; and each said mating contact element comprising a pin contact slidable into said socket contact, a sleeve being fixed to and surrounding each said pin contact providing an annular space therebetween slidably receiving said socket contact; and sleeve having a rearwardly facing shoulder thereon; and said retaining means comprising a radially inwardly forwardly extending resilient finger means in said body engaging said shoulder.

* * * * *